US009315997B2

(12) United States Patent
Smed et al.

(10) Patent No.: US 9,315,997 B2
(45) Date of Patent: Apr. 19, 2016

(54) TAMPER EVIDENT WALL CLADDING SYSTEM

(71) Applicant: DIRTT Environmental Solutions, Ltd., Calgary (CA)

(72) Inventors: Mogens Smed, DeWinton (CA); Geoff Gosling, Calgary (CA)

(73) Assignee: DIRTT Environmental Solutions, LTD, Calgary, CA (US)

( * ) Notice: Subject to any disclaimer, the term of this patent is extended or adjusted under 35 U.S.C. 154(b) by 0 days.

(21) Appl. No.: 14/000,662

(22) PCT Filed: Apr. 10, 2013

(86) PCT No.: PCT/US2013/036021
§ 371 (c)(1),
(2) Date: Aug. 21, 2013

(87) PCT Pub. No.: WO2013/155215
PCT Pub. Date: Oct. 17, 2013

(65) Prior Publication Data

US 2015/0267405 A1 Sep. 24, 2015

Related U.S. Application Data

(60) Provisional application No. 61/622,516, filed on Apr. 10, 2012.

(51) Int. Cl.

| | |
|---|---|
| ***E04C 2/30*** | (2006.01) |
| ***E04C 2/52*** | (2006.01) |
| ***E04B 2/74*** | (2006.01) |
| ***E04B 2/00*** | (2006.01) |

(52) U.S. Cl.
CPC ..... *E04C 2/526* (2013.01); *E04B 2/7448* (2013.01); *E04C 2/46* (2013.01); *E04B 2002/7461* (2013.01); *E04B 2002/7462* (2013.01)

(58) Field of Classification Search
CPC ... Y10T 403/11; Y10T 428/15; E01F 9/0182; E04B 1/94; E04B 2001/2441; E04B 2001/2481
USPC ..... 52/98
See application file for complete search history.

(56) References Cited

U.S. PATENT DOCUMENTS

| | | | | |
|---|---|---|---|---|
| 4,918,886 | A | 4/1990 | Benoit | |
| 2006/0059806 | A1 | 3/2006 | Gosling | |
| 2008/0086952 | A1* | 4/2008 | Holwick | E04G 21/30 52/3 |

FOREIGN PATENT DOCUMENTS

| | | |
|---|---|---|
| JP | 04116502 | 10/1992 |
| KR | 20020079129 | 10/2002 |
| KR | 2009012357 | 12/2009 |
| KR | 20100002049 | 2/2010 |

OTHER PUBLICATIONS

International Search Report and Written Opinion for PCT/US2013/036021 mailed Jul. 10, 2013.
European Search Report for EP13775987 dated Feb. 9, 2016.

* cited by examiner

*Primary Examiner* — Patrick Maestri
(74) *Attorney, Agent, or Firm* — Workman Nydegger

(57) ABSTRACT

Implementations of the present invention relate to systems, methods, and apparatus for protecting individual spaces formed by modular walls from unauthorized and/or undetected entry. More specifically, at least one implementation includes tamper evident panels that can indicate unauthorized removal thereof and/or indicate an occurrence of unauthorized entry into a protected individual space.

20 Claims, 4 Drawing Sheets

TAMPER EVIDENT WALL CLADDING SYSTEM

CROSS-REFERENCE TO RELATED APPLICATIONS

The present application is a 35 U.S.C. §371 U.S. National of PCT Patent Application No. PCT/US 13/36021 filed Apr. 10, 2013, entitled "Tamper Evident Wall Cladding System," which claims priority to U.S. Provisional Patent Application No. 61/622,516, filed Apr. 10, 2012, entitled "Tamper Evident Wall Cladding System." The entire content of each of the foregoing applications is incorporated herein by reference.

BACKGROUND OF THE INVENTION

1. The Field of the Invention

This invention relates to systems, methods, and apparatus for protecting individual spaces formed by modular walls or partitions from unauthorized and/or undetected entry.

2. Background and Relevant Art

Office space can be relatively expensive due to the basic costs of the location and size of the office space. In addition to these costs, an organization may incur further expense configuring the office space in a desirable layout. An organization might purchase or rent a large open space in a building, and then subdivide or partition the open space into various offices, conference rooms, or cubicles. Rather than having to find new office space and move as an organization's needs change, it is often desirable to reconfigure the existing office space. Many organizations address their configuration and reconfiguration issues by dividing large, open office spaces into individual work areas using modular wall segments (or wall modules) and partitions.

In particular, at least one advantage of modular wall systems is that they can be relatively easy to configure. In addition, modular wall systems can be less expensive to set up and can allow for reconfiguration more easily than more permanently constructed office dividers. For example, an organization can construct a set of offices and a conference area within a larger space in a relatively short period of time with the use of modular wall systems. If office space needs change, the organization can readily reconfigure the space.

In general, modular office partitions typically include a series of individual wall modules (and/or panels). The individual wall modules are typically free-standing or rigidly attached to one or more support structures. In particular, a manufacturer or assembler can usually align and join the various wall modules together to form an office, a room, a hallway, or otherwise divide an open space.

Typical modular walls may include removable panels or cladding that form the wall surfaces of the modular walls. Ability to remove and replace the panels provides greater flexibility and adaptability for the modular walls, allowing the users to reconfigure existing modular walls for a particular use and/or desired design or style. For instance, users can update or remodel their individual spaces by replacing the panels on the modular walls to reflect new architectural styles, furniture choices, as well as other considerations.

As such, while modular walls can provide flexibility for dividing, configuring, and reconfiguring open spaces, individual spaces configured with modular walls can be vulnerable to unauthorized and/or undetected intrusion. Specifically, an unauthorized user can remove one or more of the panels to gain access into the adjacent space separated by the modular wall. Moreover, such unauthorized user can reattach the panels and exit the individual space undetected.

Accordingly, there are a number of disadvantages in protecting and/or securing individual spaces formed by modular walls that can be addressed.

BRIEF SUMMARY OF THE INVENTION

Implementations of the present invention provide systems, methods, and apparatus for protecting individual spaces formed by modular walls or modular partitions from unauthorized and/or undetected entry. More specifically, at least one implementation includes tamper evident panels (or tiles) that can indicate unauthorized removal thereof and/or indicate an occurrence of unauthorized entry into a protected individual space. As such, the tamper evident panels can deter unauthorized users from removing the tamper evident panels from the modular wall. Furthermore, the tamper evident panels can alert staff and/or security personnel to a breach of security in a particular individual space.

At least one implementation includes a tamper evident panel for a modular wall that defines one or more individual spaces in a building. Such tamper evident panel provides an alert in response to unauthorized removal of the tamper evident panel from a protective wall module. The tamper evident panel includes an outward facing major surface and an inward facing major surface opposite to the outward facing major surface. In addition, the tamper evident panel includes one or more mounting connectors coupled to or integrated with the inward facing major surface. The one or more mounting connectors are sized and configured to removably couple the tamper evident panel to a frame of the protective wall module. The tamper evident panel also includes a breakaway portion defined by a breakaway contour in the inward facing major surface. The breakaway portion is configured to couple to the frame of the protective wall module. Moreover, the breakaway portion is configured to break away from the rest of the tamper evident panel when the tamper evident panel is removed from the frame of the protective wall module and while the breakaway portion is coupled to the frame of the protective wall module.

Implementations of the present invention also include a protective wall module for forming modular walls that can divide space of a building into individual spaces. The modular walls are configured to protect an individual space from unauthorized or undetected entry. The protective wall module includes at least one vertical support member and at least one horizontal support member coupled to the at least one vertical support member. The at least one vertical support member and the at least one horizontal support member defining a frame. Furthermore, the protective wall module includes a first tamper evident panel coupled on a first side of the frame to one or more of the at least one vertical support member and the at least one horizontal support member. The protective wall module also includes at least one tamper evidencing mechanism configured to break the first tamper evident panel into two or more portions upon triggering of the tamper evidencing mechanism.

Additional or alternative implementations include a modular wall for dividing a space of a building into multiple individual spaces and for protecting at least one individual space from an unauthorized or undetected entry. The modular wall includes one or more protective wall modules at least partially defining a protected area. Each protective wall module of the one or more protective wall modules includes a frame, one or more tamper evident panels coupled to the frame, and a tamper evidencing mechanism configure to break the one or more tamper evident panels into a breakaway portion and a remaining portion thereof upon triggering of the tamper evidencing mechanism.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
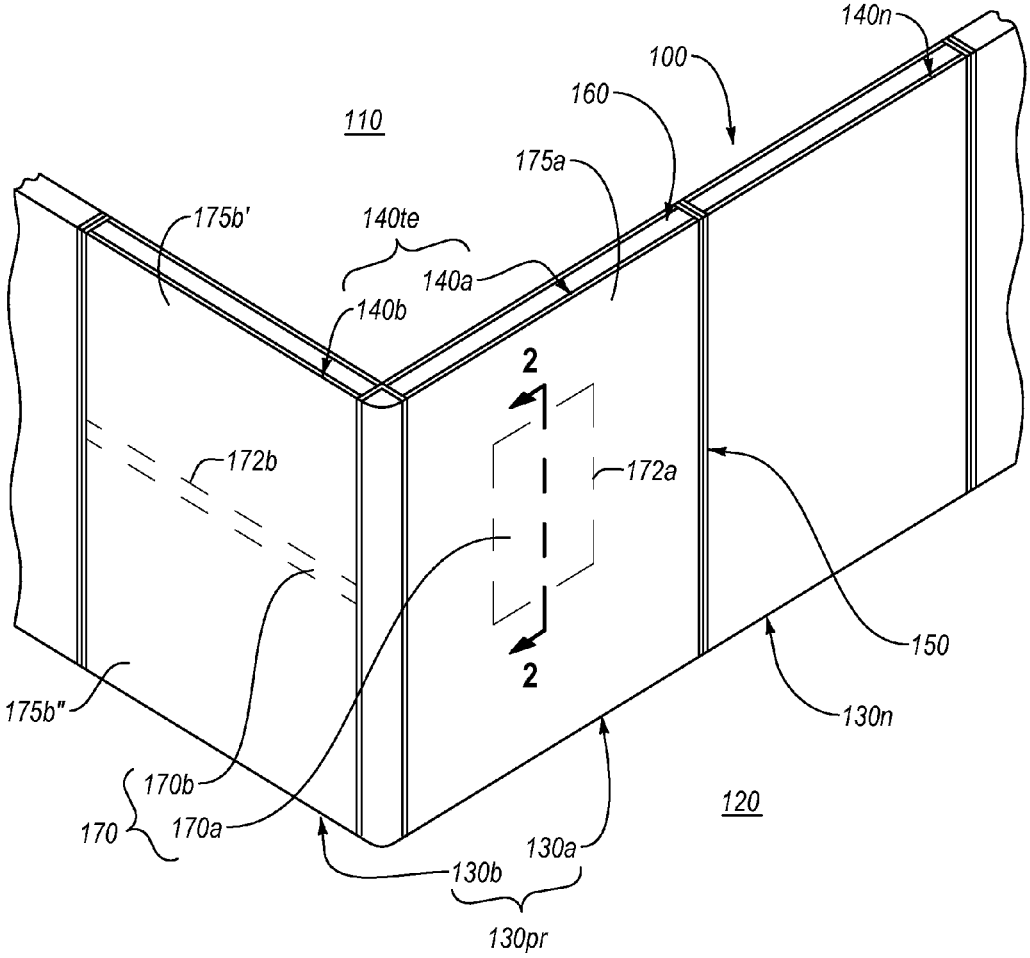
FIG. 1 illustrates a perspective view of a portion of a modular wall that incorporates protective wall modules in accordance with one implementation of the present invention.

Implementations of the present invention provide systems, methods, and apparatus for protecting individual spaces formed by modular wall or modular partitions from unauthorized and/or undetected entry. More specifically, at least one implementation includes tamper evident panels (or tiles) that can indicate unauthorized removal thereof and/or indicate an occurrence of unauthorized entry into a protected individual space. As such, the tamper evident panels can deter unauthorized users from removing the tamper evident panels from the modular wall. Furthermore, the tamper evident panels can alert staff and/or security personnel to a breach of security in a particular individual space.

In at least one implementation, the installer can secure tamper evident panels on one side of a modular wall. Additionally, an authorized installer or user can remove the tamper evident panel from the opposite side of the modular wall. In other words, the modular wall can separate a protected area from an unprotected area. Thus, the authorized user can deactivate a tamper evidencing mechanism of the tamper evident panel, by removing a panel on the protected side of the modular wall to access and disable or deactivate the tamper evidencing mechanism of the tamper evident panel. Subsequently, the authorized installer or user can remove the tamper evident panel from the modular wall without triggering the tamper evidencing mechanism (e.g., without damage to the tamper evident panel).

In alternative implementations, the tamper evident panels can be on opposing sides of the modular wall. For instance, such modular wall can separate two protected individual spaces, both of which have restricted access, and can provide evidence of unauthorized entry into either of such individual spaces. Hence, such tamper evident panels can couple to a frame of the modular wall in a manner that removal of the tamper evident panel from either side of the modular wall can result in triggering the tamper evidencing mechanism (e.g., damaging or breaking the tamper evident panel). Consequently, in one example, even an authorized user may not be able to remove the tamper evident panel without triggering the tamper evidencing mechanism.

Generally, a tamper evident panel can incorporate a tamper evidencing mechanism that can permanently change the exterior appearance of the tamper evidencing panel. For instance, the tamper evidencing mechanism can damage or break the tamper evident panel or a portion thereof. Additionally or alternatively, the tamper evidencing mechanism can permanently deform the tamper evident panel in a manner that can alert security personnel to the unauthorized removal of such tamper evident panel. In any event, the tamper evident panel can be permanently changed in a manner that indicates removal of such tamper evident panel from the modular wall.

Additionally, in one implementation of the present invention, the tamper evidencing mechanism can allow a user to remove the tamper evident panel through a particular sequence of operations (i.e., disengagement sequence) known to the particular user. Conversely, removal of the tamper evident panel in a manner that deviates from the disengagement sequence can trigger the tamper evidencing mechanism. For example, the user can first disconnect one side of the tamper evident panel from the frame of the modular wall, subsequently disengage the tamper evidencing mechanism, and remove the tamper evident panel.

As a preliminary matter, frequent reference is made herein to modular walls or wall modules. A modular wall is intended to mean any wall that facilitates configuration and reconfiguration of individual spaces (i.e., the wall modules that comprise the modular wall may be selectively removable and replaceable and may couple together in any number of suitable configurations). The present invention applies to many different types of modular walls and wall modules and is not limited to any particular modular wall and/or wall module such as those shown in the Figures.

As mentioned above, upon removal of the tamper evident panel from the modular wall, the tamper evidencing mechanism can damage or break the tamper evident panel, thereby alerting authorities to the removal of the tamper evident panel as well as to a potentially unauthorized entry into a protected area. FIG. 1 illustrates an exemplary configuration of a modular wall 100. Particularly, the modular wall 100 can separate a first or protected individual space 110 from a second or unprotected individual space 120. In one implementation, the protected individual space 110 can be safeguarded by the modular wall 100.

The modular wall 100 can include a single or multiple protective wall modules 130*pr* (e.g., protective wall modules 130*a*, 130*b*). More specifically, the protective wall modules 130*pr* can define the boundaries of the protected individual space 110 as well as those of the unprotected individual space 120. Additionally, each of the protective wall modules 130*pr* can include a frame and a panel mounted or coupled to the frame. For example, the protective wall modules 130*pr* can incorporate at least one tamper evident panel 140*te*, such as tamper evident panels 140*a*, 140*b*.

The modular wall 100 also can include non-protective wall modules, such a wall module 130*n*, which may couple to each other as well as to the protective wall modules 130*pr*. The wall module 130*n* can incorporate a regular panel 140*n* that can be a removable and/or a non-removable panel. For instance, one or more of the wall modules that comprise the modular wall 100 can have one or more regular panels that can be permanently or semi-permanently coupled to the wall modules. Additionally, any of the protective wall modules 130*pr* as well as wall modules 130*n* (and the modular wall 100 generally) can couple to a permanent or semi-permanent wall that can in part define the open space or one or more individual spaces.

It should be appreciated that aspects of the protective wall modules 130*pr* may be similar to or the same as the wall module 130*n*. Specifically, an outward facing major surface of the tamper evident panel 140*te* can appear similar to or the same as an outward facing major surface of the regular panel 140*n*. In other words, the tamper evident panel 140*te* may be indistinguishable from and appear the same as the regular panel 140*n*. Hence, an unauthorized entrant may not know which panel is the tamper evident panel 140*te* and which is the regular panel 140*n*. In one or more implementations, all of the panels may be tamper evident panels 140*te*.

In one or more implementations, the protective wall modules 130*pr* can include one or more vertical support members, such as vertical support members 150. The protective wall modules 130*pr* also can include at least one horizontal support member, such as a horizontal support member 160. The vertical support members 150 and the horizontal support members, including the horizontal support member 160 can couple together to form the frames of the protective wall modules 130*pr*. For instance, the vertical support members 150 can connect directly to the horizontal support members, including the horizontal support member 160. Additionally or alternatively, the tamper evident panels 140*te* can couple together the vertical support members 150 and the horizontal support member 160. In any event, the vertical support members 150 and the horizontal support members (including the horizontal support member 160) can form the frame of the protective wall modules 130*pr*, which can support the tamper evident panels 140*te*.

In one or more implementations, the tamper evident panels 140*te* can incorporate one or more breakaway areas that can break away from a remaining portion of the tamper evident panel 140*te* to evidence tampering therewith. Particularly, the tamper evident panel 140*te* can have one or more breakaway portions 170 thereon. As further described below, a breakaway contour (e.g., breakaway contours 172*a*, 172*b*) can define the shape of the breakaway portions 170. Specifically, the breakaway contours 172*a*, 172*b* can provide a weakened contour on the tamper evident panel 140*te*, which can facilitate breaking of the breakaway portions 170 along a predictable and predetermined contour and in a predetermined manner.

In the implementation illustrated in FIG. 1, the tamper evident panel 140*a* includes a breakaway portion 170*a* that can break away from a remaining portion 175*a*. Similarly, the tamper evident panel 140*b* has a breakaway portion 170*b* that can break away from remaining portions 175*b*', 175*b*". When someone removes the tamper evident panels 140*te* from the protective wall modules 130*pr*, the breakaway portions 170 can remain connected to the frames of the respective protective wall modules 130*pr*. Hence, the breakaway portions 170 can break away from the remaining portions of the tamper evident panel 140*te*, thereby indicating the removal of the tamper evident panel 140*te*, which may have been unauthorized. Furthermore, as noted above, when the breakaway portions 170 break away from the remaining portions 175*a*, 175*b*', 175*b*" of the tamper evident panels 140*te*, the breakaway portions 170 also can indicate that someone entered the protected individual space 110 without authorization.

In one example, the breakaway portions 170 can remain on the protective wall modules 130*pr*, after removal of the tamper evident panel 140*te* therefrom. For instance, the breakaway portions 170 can couple to one or more horizontal and/or vertical members that comprise the protective wall modules 130*pr* (i.e., the breakaway portions 170 can be secured to the respective frames of the protective wall modules 130*pr*). Alternatively, as further described below, the breakaway portions 170 can come off or drop from the frame of the protective wall modules 130*pr*. In any case, reconstructing any of the tamper evident panels 140*te* from the breakaway portions 170 and the remaining portions 175*a*, 175*b*', 175*b*" of the tamper evident panels 140*te* can be difficult or impossible.

In light of this disclosure, those skilled in the art should appreciate that the breakaway portions 170 can have any number of shapes, sizes, orientations, and positions on the tamper evident panels 140*te*, which can vary from one implementation to another. For example, the breakaway portion 170*a* can be confined within the tamper evident panel 140*a*, in a manner that the tamper evident panel 140*a* can remain as a single piece with the breakaway portion 170*a* removed therefrom after triggering of the tamper evidencing mechanism. In other words, the breakaway portion 170*a* can have a shape and size that fits within the perimeter of the tamper evident panel 140*a*.

The breakaway portion 170*a* can have a rectangular shape. In one or more other implementations, however, the breakaway portion 170*a* can have a square shape, rounded shape (circular, oval, elliptical, etc.), irregular shape, and various combinations thereof. The shape also may provide a message or an alert to staff and/or security personnel, which can serve as an indication of an unauthorized entry. One example of such shape can be a combination of letters that form a word or a statement that informs of unauthorized removal of the tamper evident panels 140*te* and/or of unauthorized entry into the protected individual space 110. Additionally or alternatively, the shape can be a symbol that can inform about the unauthorized entry (e.g., an exclamation sign).

Implementations of the present invention contemplate a breakaway section that can divide or break the panel into multiple remaining portions. For instance, the breakaway portion 170*b* can break away from and form the remaining portions 175*b*', 175*b*". Such division or breaking of the tamper evident panel 140*b* can prevent or impede reassembly and/or repair of the tamper evident panel 140*b* after the breakaway portion 170*b* has been broken away from the remaining portions 175*b*', 175*b*".

It should be noted that, although the tamper evident panel 140*b* can break into three portions (i.e., the breakaway portion 170*b* and the remaining portions 175*b*', 175"), the number of such portions can vary from one implementation to another. Furthermore, as noted above, shapes of the breakaway portion(s) and, thus, of the corresponding remaining portions can vary from one implementation to another. Accordingly, the tamper evident panel 140*b* can break into multiple portions of various sizes and shapes, and some of the portions may remain attached to the frame of the protective wall module 130*b* after the triggering of the tamper evidencing mechanism. Hence, such multiple portions of the broken tamper evident panel 140*b* can present a substantial challenge to reassembling the various portions back together into the tamper evident panel 140*b*.

Figure 2A:
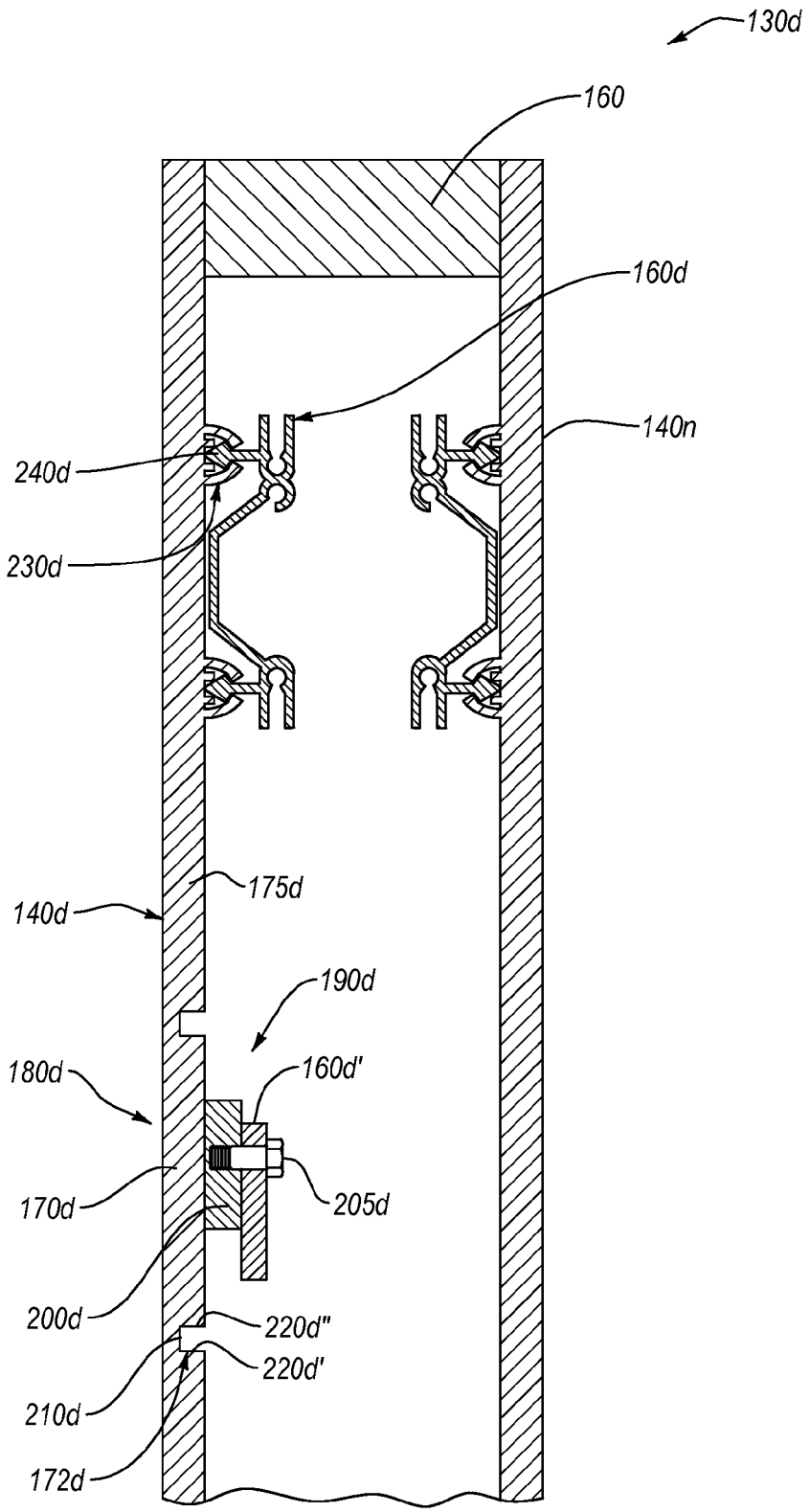
FIG. 2A illustrates a cross-sectional view of a protective wall module in accordance with one implementation of the present invention.

In any event, breaking away of the breakaway portions 170 from the remaining portions 175*a*, 175*b*', and/or 175*b*" of the tamper evident panels 140*te* can form multiple portions that may be prohibitive of reassembly of any of the tamper evident panels 140*te* into a respective single panel. Moreover, as noted above, the breakaway portions 170 can remain secured or attached to the frames of the protective wall modules 130*pr*. For example, FIG. 2A illustrates a protective wall module 130*d* that includes a tamper evident panel 140*d*, which may have a tamper evidencing mechanism 180*d*. Particularly, the tamper evidencing mechanism 180*d* can include the breakaway portion 170*d* and a coupling mechanism 190*d* that can provide differential movement between the breakaway portion 170*d* and remaining portion 175*d* of the tamper evident panel 140*d*.

For instance, as described above, removal of the tamper evident panel 140*d* from the protective wall module 130*b* can trigger the tamper evidencing mechanism 180*d*, which can break apart and/or breakaway the breakaway portion 170*b* from the tamper evident panel 140*d*. Specifically, the coupling mechanism 190*b* includes a portion of a horizontal support member 160*d*' (e.g., a portion of the horizontal support member including a hole or an opening therein) and a coupling block 200*d*. The coupling mechanism 190*b* can couple the breakaway portion 170*d* to the horizontal support member 160*d*'. Accordingly, in one or more implementations, if the tamper evident panel 140*d* moves away from the frame of the protective wall module 130*d*, the breakaway portion 170*d* can remain coupled to the frame of the protective wall module 130*d* (i.e., to the horizontal support member 160*d*'). As such, the tamper evident panel 140*d* can break into the breakaway portion 170*b* and the remaining portion 175*d*.

The coupling block 200*b* can couple to the breakaway portion 170*d* in any number of ways, which can vary from one implementation to another. For instance, the manufacturer can glue the coupling block 200*d* to the breakaway portion 170*d* of the tamper evident panel 140*d*. Alternatively, the manufacturer can screw, bolt, or otherwise secure the coupling block 200*b* to the breakaway portions 170*b* of the tamper evident panel 140*b*. In any event, the coupling block 200*b* can provide an interface for the horizontal support member 160*d*' to secure or couple the breakaway portion 170*b*.

The horizontal support member 160*d*' can couple to the coupling block 200*d* with various mechanical connectors or connection types. For example, the coupling mechanism 190*d* can include a bolt or screw 205*d*, which can secure the horizontal support member 160*d*' to the coupling block 200*d*, thereby securing the breakaway portion 170*d* to the horizontal support member 160*d*'. In alternative or additional implementations, the coupling mechanism 190*d* can include other fasteners (e.g., rivets, non-removable snap-in connectors, etc.), which may removably or semi-permanently secure the coupling block 200*d* to the horizontal support member 160*d*'. Furthermore, the manufacturer can weld, glue, or otherwise mechanically and/or chemically couple the horizontal support member 160*d*' to the coupling block 200*d*. In any case, connections between the horizontal support member 160*d*' and the coupling block 200*d* as well as between the coupling block 200*d* and the breakaway portion 170*d* can be sufficiently strong or durable to maintain the breakaway portion 170*d* affixed to the frame of the protective wall module 130*d* during removal of the tamper evident panel 140*d* therefrom.

Additionally, as mentioned above, the tamper evident panel 140*d* can incorporate multiple breakaway portions, which may be similar to or the same as the breakaway portion 170*d* Likewise, depending on particular location of the breakaway portion(s) of the tamper evident panel 140*d*, the breakaway portion(s) can couple to the same horizontal support member or to multiple horizontal support members. Moreover, one or more of the breakaway portions also can couple to a single or to multiple vertical support members that comprise the frame of the protective wall module 130*d*.

To facilitate breaking, the tamper evidencing mechanism 180*d* can include a breakaway contour 172*d* about the breakaway portion 170*d*. The breakaway contour 172*d* can have any number of desired shapes, which can define a particular shape of the breakaway portion 170*d*. Additionally, however, the breakaway contour 172*d* also can have various profiles that can weaken the tamper evident panel 140*d* about the contour of the breakaway portion 170*d*. Specifically, the breakaway contour 172*d* can provide a contour along which the tamper evident panel 140*d* can fail, thereby breaking into the breakaway portion 170*d* and the remaining portion 175*d*. For instance, the breakaway contour 172*d* can have a substantially rectangular or square profile. In other words, the breakaway contour 172*d* can have a substantially flat bottom portion 210*d* and opposing side portions 220*d*', 220*d*" approximately perpendicular to the bottom portion 210*d*.

It should be appreciated that an interface between the bottom portion 210*d* and the side portion 220*d*' or 220*d*" can form one or more sharp corners, which can act as points that can initiate breaking away of the breakaway portion 170*d* along the breakaway contour 172*d*. For example, a sharp corner can facilitate crack or fracture propagation about the breakaway contour 172*d*. As such, the breakaway contour 172*d* can have any number of suitable profiles (e.g., a profile with a triangular, rectangular, or other cross-section), which can facilitate breaking away of the breakaway portion 170*d* along the breakaway contour 172*d*.

The depth of the breakaway contour 172*d* can be a distance between the inward facing major surface of the tamper evident panel 140*d* and the bottom portion 210*d* of the breakaway contour 172*d*. Additionally, the depth of the breakaway contour 172*d* (measured from the inward facing major surface of the tamper evident panel 140*d* to the bottom portion 210*d*) can be sufficient to break away the breakaway portion 170*d* from the remaining portion 175*d*. Specifically, a remaining thickness (i.e., the distance between the outward facing major surface and the bottom portion 210*d* of the breakaway contour 172*d*, can fail in response to removal of the tamper evident panel 140*d* from the frame of the protective wall module 130*d*.

This disclosure, however, is not limited to breakaway contour 172*d* that have profiles which include one or more sharp corners. In one or more implementations, the profile of the breakaway contour 172*d* can have no sharp corners (e.g., a profile having a rounded cross-section). Furthermore, in light of this disclosure, those skilled in the art should appreciate that the tamper evident panel 140*d* can comprise any number of suitable materials (e.g., thermoplastic materials, wood, glass, etc.) Among other considerations, the manufacturer can choose the profile of the breakaway contour 172*d* based on the physical characteristics of the particular material comprising the tamper evident panel 140*d*. For example, the manufacturer can choose the profile of the breakaway contour

172*d* (including the depth thereof) based on the elasticity of the material and strength of the material comprising the tamper evident panel 140*d*.

Moreover, the breakaway contour 172*d* may be continuous or interrupted. In other words, the breakaway contour 172*d* can form a continuous channel in the tamper evident panel 140*d* (at a depth from the inward facing major surface of the tamper evident panel 140*d*). Alternatively, however, the breakaway contour 172*d* can be interrupted (e.g., a channel having variable depths; series of blind (not through) holes that form the breakaway contour 172*d*, etc).

As described above, the breakaway portion 170*d* can fixedly couple to the frame of the protective wall module 130*d*. In other words, the breakaway portion 170*d* can couple to the frame of the protective wall module 130*d* in a manner that prohibits removal or detachment of the breakaway portion 170*d* from the frame of the protective wall module 130*d* from the side of the outward facing major surface of the tamper evident panel 140*d*. By contrast, the remaining portion 175*d* can removably couple to the frame of the protective wall module 130*d*, such that the user can detach the remaining portion 175*d* of the tamper evident panel 140*d* from the outward facing side thereof.

In one exemplary implementation, the tamper evident panel 140*d* can include snap-in connectors 230*d*, located on the remaining portion 175*d*. The snap-in connectors 230*d* can couple the tamper evident panel 140*d* to the frame of the protective wall module 130*d*. Specifically, the frame of the protective wall module 130*d* can include a horizontal support member 160*d* that can have protruding members 240*d* that can correspond with and couple to the snap-in connectors 230*d*. For example, the snap-in connectors 230*d* can snap into the protruding members 240*d*, thereby coupling the tamper evident panel 140*d* to the horizontal support members, such as the horizontal support member 160*d*.

Hence, the authorized user or installer can detach and remove the tamper evident panel 140*d* from the frame of the protective wall module 130*d*. Specifically, the installer can decouple the breakaway portion 170*d* from the horizontal support member 160*d*' (e.g., by unscrewing the screw 205*d* from the coupling block 200*d*) and can pull the tamper evident panel 140*d* away from the frame, detaching the snap-in connectors 230*d* from the protruding members 240*d*. Conversely, to secure the tamper evident panel 140*d* to the frame of the protective wall module 130*d*, the installer can first couple snap-in connectors 230*d* to the protruding members 240*d*. Subsequently, the installer can couple the breakaway portion 170*d* to the horizontal support member 160*d*' (as described above).

Figure 2B:
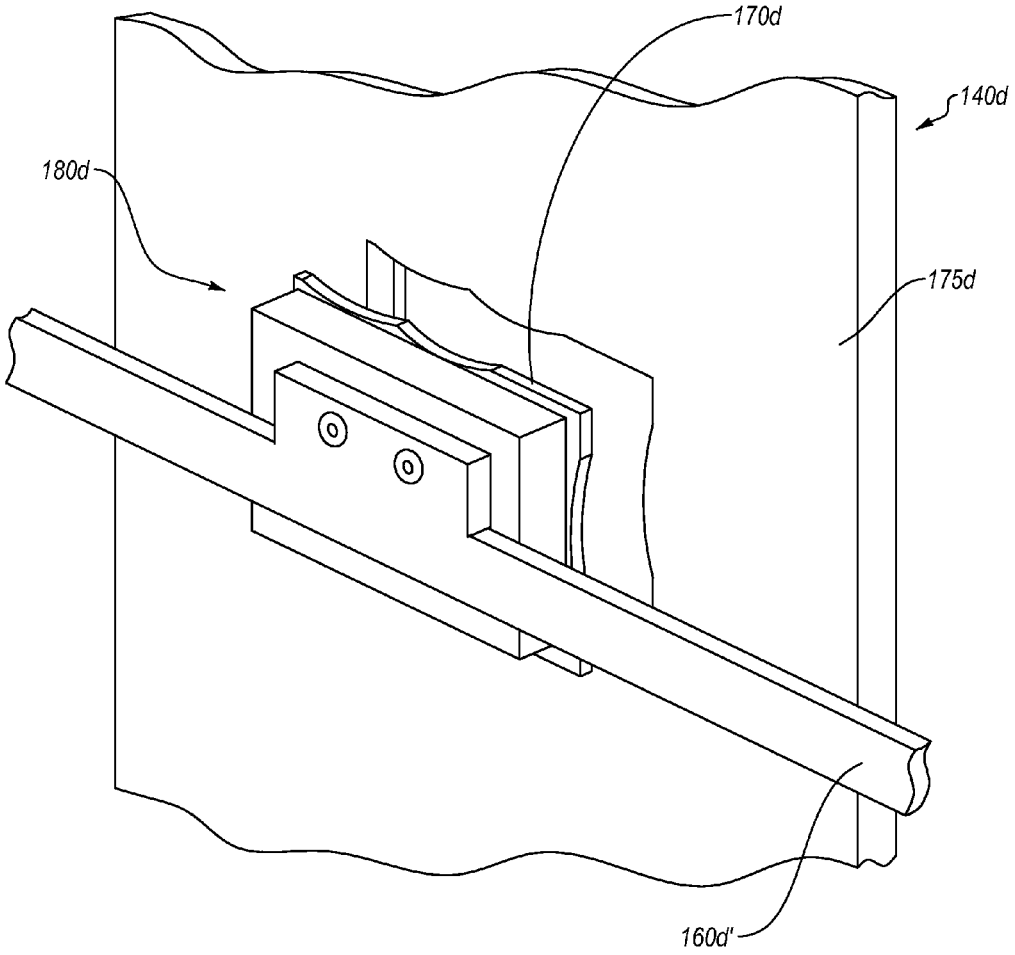
FIG. 2B illustrates a perspective view of a protective wall module of FIG. 2A after triggering of a tamper evidencing mechanism.

By contrast, as illustrated in FIG. 2B, removal of the tamper evident panel 140*d* from the side of the outer surface thereof without disconnecting the breakaway portion 170*d* from the horizontal support member 160*d*' can result in triggering of the tamper evidencing mechanism 180*d*. Specifically, the tamper evident panel 140*d* can separate into the breakaway portion 170*d* and the remaining portion 175*d*, along the breakaway contour that defines the shape of the breakaway portion 170*d*. For instance, the breakaway portion 170*d* of the tamper evident panel 140*d* can remain attached to the horizontal support member 160*d*' after the breakaway portion 170*d* breaks away from the tamper evident panel 140*d*, thereby providing an alert about an occurrence of a removal of the tamper evident panel 140*d*.

Referring back to FIG. 2A, it should be noted that, in addition to the tamper evident panel 140*d*, the protective wall module 130*d* can include the regular panel 140*n*, opposite to the tamper evident panel 140*d*. Specifically, the regular panel 140*n* may face the protected area, while the tamper evident panel 140*d* can face the unprotected area. Accordingly, in at least one implementation the authorized person (e.g., the occupant of the protected area) can remove regular panel 140*n* from the protective wall module 130*d* without triggering the tamper evidencing mechanism. For instance, the regular panel 140*n* can removably couple to protruding members (e.g., similar to protruding members 240*d*) of the frame of the protective wall module 130*d* with snap-in connectors, similar to the snap-in connectors 230*d*. Consequently, the user can selectively detach the regular panel 140*n* from the frame of the protective wall module 130*d*.

Moreover, the user or other authorized personnel can access the coupling mechanism 190*d*, which secures the breakaway portion 170*d* to the horizontal support member 160*d*' by removing the regular panel 140*n* from the frame of the protective wall module 130*d*. After detaching the regular panel 140*n* from the frame of the protective wall module 130*d*, the authorized user can have access to the coupling mechanism 190*d*. Specifically, the authorized person can unscrew the screw 205*d*, thereby decoupling the breakaway portion 170*d* from the horizontal support member 160*d*'. Subsequently, the authorized person can detach the tamper evident panel 140*d* from the frame of the protective wall module 130*d*, without triggering the tamper evidencing mechanism 180*d* (i.e., without damaging the tamper evident panel 140*d*).

Figure 3B:
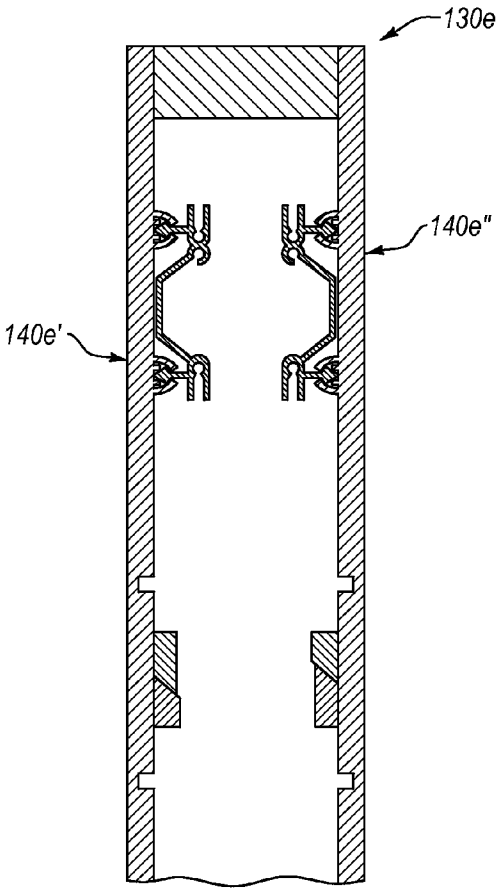
FIG. 3B illustrates a cross-section view of a fully assembled protective wall module of FIG. 3A.
Figure 3A:
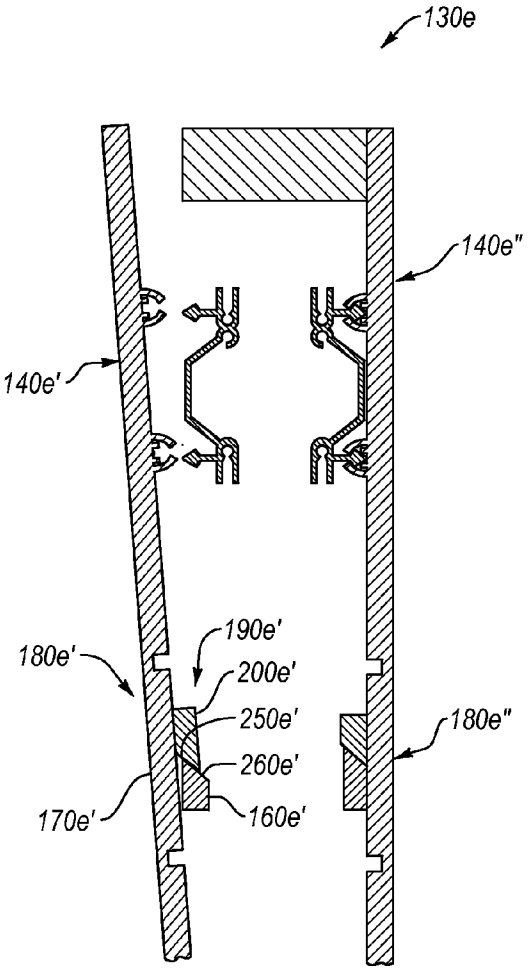
FIG. 3A illustrates a cross-sectional view of a partially assembled protective wall module in accordance with another implementation of the present invention.

It should be appreciated that, as mentioned above, this invention is not limited to wall modules that include a single tamper evident panel. For example, as illustrated in FIGS. 3A-3B, a protective wall module 130*e* can incorporate first and second tamper evident panels 140*e*', 140*e*" on opposing sides thereof. Thus, the protective wall module 130*e* can protect at least two individual spaces located on opposite sides thereof. Except as otherwise described herein, the protective wall module 130*e* and all of the components or elements thereof can be similar to or the same as the protective wall module 130*d* (FIGS. 2A-2B) and its respective components or elements.

Additionally, the protective wall module 130*e* can allow attachment and safe removal of the tamper evident panels 140*d*', 140*d*" from the frame of thereof, through a particular sequence of steps or acts. Specifically, the protective wall module 130*e* can include tamper evidencing mechanisms 180*e*', 180*e*", which can register unauthorized removal of the respective tamper evident panels 140*e*', 140*e*" from the frame of the protective wall module 130*e*. In one implementation, the tamper evidencing mechanism 180*e*' can be substantially the same as the tamper evidencing mechanism 180*e*". For instance, the tamper evidencing mechanism 180*e*' can include a breakaway portion 170*e* and a coupling mechanism 190*e*', which can couple the breakaway portion 170*e*' to a horizontal support member 160*e*' of the frame of the protective wall module 130*e*.

In one or more implementations, the coupling mechanism 190*e*' can allow the installer to couple the breakaway portion 170*e*' to the horizontal support member 160*e*' from the outward facing side of the tamper evident panel 140*e*'. In other words, the installer may not need to access the opposite side of the tamper evident panel 140*e*' (e.g., by removing the opposing panel) to attach the tamper evident panel 140*e*' to the horizontal support member 160*e*'. Moreover, the installer also can remove the tamper evident panel 140*e*' from the outward facing side thereof. Such configuration can allow the protective wall module 130*e* to incorporate dual, opposing tamper evident panels 140*e*', 140*e*".

Particularly, the coupling mechanism 190*e*' can include a coupling block 200*e*' that has a least one angled face 250*e*'.

For instance, the angled face 250*e*' can form an acute angle relative to the inward facing portion of the breakaway portion 170*e*'. Alternatively, the angled face 250*e*' can form an obtuse angle relative to the inward facing portion of the breakaway portion 170*e*'. The horizontal support member 160*e*' also can incorporate an angled locking face 260*e*', which can correspond with the angled face 250*e*'. In other words, the angled locking face 260*e*' can contact the angled face 250*e*' of the coupling block 200*e*', thereby securing the coupling block 200*e*' to the horizontal support member 160*e'*.

For example, the tamper evident panel 140*e*' can comprise a flexible material, which can allow for sufficient bending without breaking. Hence, the installer first can position the tamper evident panel 140*e*' at an acute angel relative to the frame of the protective wall module 130*e* (as shown in FIG. 3A), and slide the angled face 250*e*' over the angled locking face 260*e*' part of the way. Subsequently, the installer can connect the bottom portion of the tamper evident panel 140*e*' to the frame of the protective wall module 130*e* (e.g., by connecting corresponding snap-in connectors on the tamper evident panel 140*e*' to the protruding members on the frame).

Depending on the particular angles of the angled face 250*e*' and of the angled locking face 260*e*', the installer may flex the tamper evident panel 140*e*' and/or the corresponding connectors while connecting the bottom portion of the tamper evident panel 140*e*' to the frame of the protective wall module 130*e*. As noted above, however, the tamper evident panel 140*e*' and/or the connectors (e.g., the snap-in connectors) can have sufficient flexibility to accommodate such bending. Furthermore, the breakaway portion 170*e*' of the tamper evident panel 140*e*' can remain unbroken therefrom during such bending. Thereafter, the installer can connect the upper portion of the tamper evident panel 140*e*' to the frame of the protective wall module 130*e*, thereby completing the installation, as illustrated in FIG. 3B.

Additionally or alternatively, the snap-in connectors on the tamper evident panel 140*e*' and/or the protruding members on the frame can have sufficient flexibility to allow the installer to secure the tamper evident panel 140*e*' to the frame without bending the tamper evident panel 140*e*'. In other words, the installer can deflect or bend the protruding member of the frame to couple the coupling block 200*e*' to the horizontal member 160*e*'. Accordingly, implementation of the present invention also include protective wall modules 130*e* that incorporate opposing temper evident panels 140*e*', 140*e*", which comprise rigid material (e.g., glass).

To decouple the tamper evident panel 140*e*' from the frame of the protective wall module 130*e*, the installer or user can perform the above acts in reverse order (i.e., installer can follow a disengagement sequence). Specifically, the installer first can detach or decouple the upper portion of the tamper evident panel 140*e*' from the frame of the protective wall module 130*e*. Thereafter, the installer can pull the tamper evident panel 140*e*' in an upward direction, in a manner that the angled face 250*e*' slides over the angle locking face 260*e*'. As such, the installer can slightly bend the tamper evident panel 140*e*', the snap-in connectors thereof, the protruding members of the frame (that couple to the snap-in connectors), and combinations thereof. In any event, the installer can move the tamper evident panel 140*e*' in a manner that releases the breakaway portion 170*e*' of the tamper evident panel 140*e*' from the horizontal support member 160*e*'. Subsequently, the installer can disconnect or decouple the lower portion of the tamper evident panel 140*e*' from the frame of the protective wall module 130*e* and remove the tamper evident panel 140*e'*.

It should be appreciated that a particular configuration of the coupling block 200*e*' and the horizontal support member 160*e*' can vary from one implementation to another. Moreover, connection angle orientations of the angled face 250*e*' and of the angled locking face 260*e*' can vary from one protective wall module to another. Accordingly, without specific knowledge of the particular connection, an unauthorized user may not know the proper sequence of acts to disconnect the tamper evident panel 140*e*' from the frame of the protective wall module 130*e* without triggering the tamper evidencing mechanism 180*e*'. For instance, implementations can include coupling mechanism 190*e*' that may require disconnecting a right portion of the tamper evident panel 140*e*' from the frame of the protective wall module 130*e* and moving the tamper evident panel 140*e*' to the right and outward, to disconnect the coupling block 200*e*' from the horizontal support member 160*e'*.

Above-described implementations include coupling mechanisms that allow decoupling of the breakaway portion of the tamper evident panel from the frame of the protective wall module. It should be noted, however, that this invention is not so limited. In at least one implementation, the breakaway portion of the tamper evident panel can be coupled to the frame of the protective wall module in a non-removable manner. In other words, the tamper evident panel may not be removable from the protective wall module without triggering the tamper evidencing mechanism (e.g., breaking a portion of the tamper evident panel). Consequently, even an authorized person may not remove such tamper evident panel from the protective module without damaging or breaking the tamper evident panel.

Particular coupling mechanisms can vary from one implementation to the next and may depend on the particular materials comprising the tamper evident panel. For example, the coupling mechanism can include a barbed protrusion that can enter a corresponding aperture and be non-removably coupled thereto. Moreover, the breakaway contour can leave a substantially thin wall section, such that the breakaway portion of the tamper evident panel can break away from the panel from a very slight force (e.g., 1 lbf).

In light of this disclosure, those skilled in the art should appreciate the outward facing major surface of the tamper evident panel may be indistinguishable from the outward facing major surface of a regular panel. Furthermore, the particular appearance and/or materials of the tamper evident panels can vary from one implementation to the other, based on particular architectural or user preferences. Generally, the tamper evident panel can comprise a single layer or may include multiple layers. For instance, one of the layers of the tamper evident panel can be a wood veneer, which can form or define the outward facing major surface of the tamper evident panel. In any case, the manufacturer can customize the appearance of the tamper evident panel, which can match the appearance of regular panels.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A tamper evident panel for a modular wall that attaches to a frame of the modular wall, the modular wall defining one or more individual spaces in a building, the tamper evident panel providing an alert in response to unauthorized removal of the tamper evident panel from a protective wall module, the tamper evident panel comprising:

an outward facing major surface;

an inward facing major surface opposite to the outward facing major surface;

one or more mounting connectors coupled to or integrated with the inward facing major surface, the one or more mounting connectors being sized and configured to removably couple the tamper evident panel to a frame of the protective wall module; and a breakaway portion defined by a breakaway contour in the inward facing major surface, the breakaway portion being configured to couple to the frame of the protective wall module, and the breakaway portion being configured to break away from the rest of the tamper evident panel when the tamper evident panel is removed from the frame of the protective wall module and while the breakaway portion is coupled to the frame of the protective wall module, the breakaway portion being configured to remain attached to the frame through a coupling mechanism upon removal of remaining portions of the tamper evident panel.

2. The tamper evident panel as recited in claim 1, wherein the breakaway contour has a cross-sectional profile that has at least one sharp corner.

3. The tamper evident panel as recited in claim 1, wherein the breakaway contour has a depth of more than half of a distance between the outward facing major surface and the inward facing major surface.

4. The tamper evident panel as recited in claim 1, wherein a depth of the breakaway contour from the inward facing major surface defines a remaining thickness, and the remaining thickness is configured to fail in response to removal of the tamper evident panel from the frame of the protective wall module.

5. The tamper evident panel as recited in claim 1, wherein the breakaway contour is not visible on the outward facing major surface.

6. The tamper evident panel as recited in claim 1, wherein the breakaway portion is surrounded by a remaining portion of the tamper evident panel, the remaining portion being defined by the breakaway contour.

7. The tamper evident panel as recited in claim 1, wherein the breakaway portion comprises a panel section that spans between two opposing edges of the tamper evident panel in a manner that divides the tamper evident panel into two remaining portions.

8. The tamper evident panel as recited in claim 1, further comprising a coupling block coupled to the breakaway portion on the inward facing major surface, the coupling block being sized and configured to couple to one or more of a horizontal support member and a vertical support member of the frame of the protective wall module.

9. A protective wall module for forming modular walls that can divide space of a building into individual spaces, the modular walls being configured to protect an individual space from unauthorized or undetected entry, the protective wall module comprising:

at least one vertical support member;

at least one horizontal support member coupled to the at least one vertical support member, the at least one vertical support member and the at least one horizontal support member defining a frame;

a first tamper evident panel coupled on a first side of the frame to one or more of the at least one vertical support member and the at least one horizontal support member; and at least one tamper evidencing mechanism configured to break the first tamper evident panel into two or more portions upon triggering of the tamper evidencing mechanism, wherein a breakaway portion of the tamper evident panel remains attached to the frame through a coupling mechanism upon removal of remaining portions of the tamper evident panel.

10. The protective wall module as recited in claim 9, wherein the at least one tamper evidencing mechanism comprises at least one breakaway portion on the first tamper evident panel and a coupling mechanism configured to couple the at least one breakaway portion of the first tamper evident panel to one or more of the at least one vertical support member and at least one horizontal support member.

11. The protective wall module as recited in claim 10, wherein the coupling mechanism is configured to removably couple the at least one breakaway portion of the first tamper evident panel to one or more of the at least one vertical support member and at least one horizontal support member.

12. The protective wall module as recited in claim 10, wherein the coupling mechanism is configured to non-removably couple the at least one breakaway portion of the first tamper evident panel to one or more of the at least one vertical support member and at least one horizontal support member.

13. The protective wall module as recited in claim 9, wherein the tamper evident panel comprises at least one breakaway portion defined by a breakaway contour, the tamper evident panel being configured to break along the breakaway contour into the at least one breakaway portion and at least one remaining portion of the tamper evident panel.

14. The protective wall module as recited in claim 9, further comprising a second panel coupled to a second side of the frame.

15. The protective wall module as recited in claim 14, wherein the second panel is a non-tamper evident panel.

16. The protective wall module as recited in claim 14, wherein the second panel is a tamper evident panel.

17. A modular wall for dividing a space of a building into multiple individual spaces and for protecting at least one individual space from an unauthorized or undetected entry, the modular wall comprising:

one or more protective wall modules at least partially defining a protected area, wherein each protective wall module of the one or more protective wall modules comprises:

a frame, one or more tamper evident panels coupled to the frame, and a tamper evidencing mechanism configured to break the one or more tamper evident panels into a breakaway portion and a remaining portion thereof upon triggering of the tamper evidencing mechanism, the breakaway portion being configured to remain attached to the frame through a coupling mechanism upon removal of remaining portions of the one or more tamper evident panels.

18. The modular wall as recited in claim 17, wherein the tamper evidencing mechanism comprises the breakaway portion coupled to the frame in a manner that the breakaway portion can remain coupled to the frame after removal of the one or more tamper evident panels from the frame, thereby breaking the one or more tamper evident panels into the breakaway portion and the remaining portion thereof.

19. The modular wall as recited in claim 17, wherein the one or more tamper evident panels comprises a first tamper evident panel coupled to a first side of the frame.

20. The modular wall as recited in claim 19, wherein the one or more tamper evident panels comprises a second tamper evident panel coupled to a second side of the frame.

* * * * *